US006570327B1

(12) United States Patent
Pinot et al.

(10) Patent No.: US 6,570,327 B1
(45) Date of Patent: May 27, 2003

(54) LAMP WITH SAFETY SWITCH

(75) Inventors: Gervais Pinot, Pont a Mousson (FR); Stéphane Coffigny, Pont a Mousson (FR)

(73) Assignee: Koninklijke Philips Electronics N.V., Eindhoven (NL)

( * ) Notice: Subject to any disclaimer, the term of this patent is extended or adjusted under 35 U.S.C. 154(b) by 173 days.

(21) Appl. No.: 09/639,148

(22) Filed: Aug. 16, 2000

(30) Foreign Application Priority Data

Aug. 17, 1999 (EP) ..... 99402077

(51) Int. Cl.[7] ..... H01K 1/34; H01K 1/66

(52) U.S. Cl. ..... 313/580; 313/25; 315/73; 315/74; 362/21

(58) Field of Search ..... 313/25, 580, 315, 313/316; 315/73, 74; 362/21

(56) References Cited

U.S. PATENT DOCUMENTS

| | | | | |
|---|---|---|---|---|
| 4,013,919 A | | 3/1977 | Corbley | 315/73 |
| 4,195,251 A | | 3/1980 | Bamberg | 315/73 |
| 4,208,614 A | | 6/1980 | Strauss et al. | 315/73 |
| 4,233,542 A | * | 11/1980 | Oostvogels et al. | 315/73 |
| 4,305,020 A | | 12/1981 | Nalepa | 315/73 |
| 4,629,939 A | | 12/1986 | Jaworowicz et al. | 315/73 |
| 4,642,520 A | | 2/1987 | Bouman et al. | 315/73 |
| 4,973,881 A | * | 11/1990 | Haraden et al. | 315/73 |

FOREIGN PATENT DOCUMENTS

| | | | |
|---|---|---|---|
| GB | 2007424 A | 5/1979 | H01J/61/56 |
| GB | 2272569 A | 5/1994 | H01K/1/66 |
| JP | 54108479 | 8/1979 | H01J/61/50 |

* cited by examiner

*Primary Examiner*—Michael H. Day
(74) *Attorney, Agent, or Firm*—Frank Keegan

(57) ABSTRACT

The invention relates to an electric lamp (100) whose light source reaches a very high temperature during operation. It mainly relates to a lamp provided with a double envelope such that a fracture or a crack of the outer envelope (2) does not prevent the lamp (100) from functioning. The lamp is therefore provided with a safety cut-out wire (5) which allows the opening of the conduction path of the lamp in case of a fracture. To this end a safety-switch portion (6) is inserted in the safety cut-out wire (5). This portion is made of a material which opens the conduction path as soon as the safety-switch portion (6) comes into contact with air.

2 Claims, 2 Drawing Sheets

LAMP WITH SAFETY SWITCH

FIELD OF THE INVENTION

The invention relates to an electric lamp comprising:

a light source provided with a light-transmitting chamber, a first and a second conductive wire connected to a first and a second end of the light source, respectively, thus forming a conduction path with the light source, an outer sealed envelope formed from a light-transmitting material and surrounding said chamber and said conductive wires, the environment between the outer envelope and said chamber being substantially without oxygen.

BACKGROUND ART

Such a lamp is described in the UK patent application GB 2,272,569. It provides a tungsten lamp which has a light-transmitting filament chamber enclosing a filament, said filament chamber being enclosed within an outer envelope. The lamp described in the prior art comprises a light source consisting in the filament chamber enclosing the tungsten filament. During lamp operation, the temperature of the light source increases strongly and could ignite any item in its neighborhood. In the event of a fracture of the outer envelope of the lamp proposed by the prior art, the light source does not necessarily stop functioning. Thus, there is a high probability that the light source at a very high temperature will ignite an external item touching it.

SUMMARY OF THE INVENTION

It is an object of the invention to provide a lamp whose light source will stop functioning as soon as the outer envelope of the lamp breaks, thus offering a high degree of safety to any external user.

To this end, the lamp described in the introduction is provided with at least a portion of at least a conductive wire, hereinafter referred to as a safety cut-out wire, made of a material which reacts chemically when in contact with air, causing the conduction path to open.

In normal operation, a conduction path is established along the first conductive wire, the light source, and the second conductive wire. The space between the outer envelope and the light source chamber is very poor in oxygen and may be vacuum or filled with a gas which does not react with any component inside the lamp. The portion of the safety cut-out wire is made of a material which reacts as soon as it is in contact with air and is chemically transformed in such a way that the conduction path is rapidly broken and the light source no longer functions. An advantage of a lamp according to the invention is that it offers a good protection against a possible ignition of an external item through contact with the light source when the outer envelope is broken or cracked. Fuses are described in the lamp of the prior art. They are connected to opposite ends of the filament to limit the magnitude and duration of an electrical arc across a break in the filament. These fuse wires are designed to melt and break the electrical contact in the event of an arc. The safety cut-out wire introduced by the invention deals with a different problem than do these fuse wires. The safety cut-out wire is not a protection against an electrical arc which may arise across a break in the filament and does not melt at high temperatures.

In a preferred embodiment of the invention, the material of said portion of the safety cut-out wire burns out when in contact with air at a temperature reached owing to radiation heat from the light source during operation.

Indeed, a light source in operation reaches very high temperatures and, as a consequence, so may the conductive wires when placed in the vicinity of the light source. Many commonly used materials burns out in a few seconds in oxygen at such a temperature level. Thus the protection provided by the safety cut-out wire can be implemented in a simple way by using common and inexpensive materials. Besides, in another embodiment of the invention, the safety cut-out wire may also be heated by the Joule effect due to a current circulating in the conductive wires.

BRIEF DESCRIPTION OF THE DRAWINGS

The particular aspects of the invention will now be explained with reference to the embodiments described hereinafter and considered in connection with the accompanying drawings, in which.

DETAILED DESCRIPTION OF THE INVENTION

Figure 1:
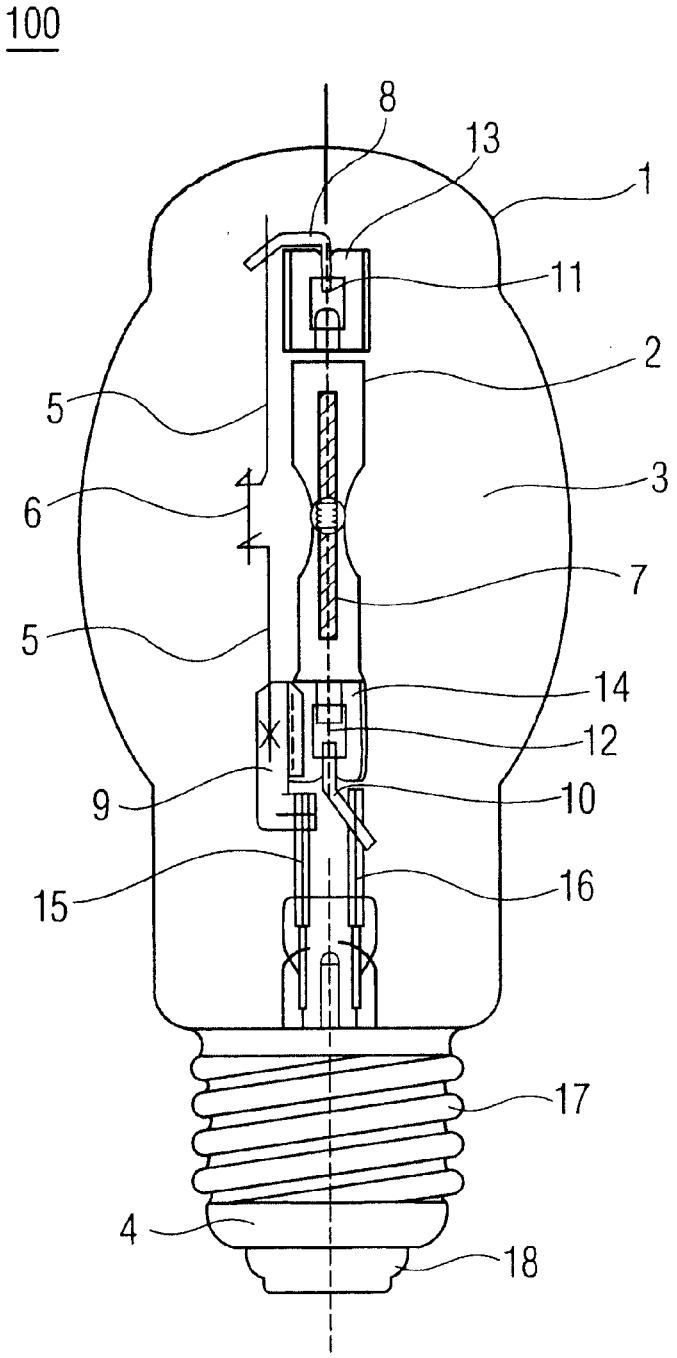
FIG. 1 is an embodiment of a lamp according to the invention.

An embodiment of the invention, applied to a tungsten halogen lamp 100, is presented in FIG. 1. It shows a tungsten halogen lamp 100 comprising a glass outer envelope 1. The outer envelope 1 is mainly made of a material transparent to light such as, for example, glass and may be covered with an opaque material in some regions in order to transmit light in certain directions. The lamp also comprises a screw base member 4 hermetically sealing the outer envelope 1. This screw base member 4 in this embodiment is provided with a usual thread 17 and a bottom contact 18, both ensuring a good electrical contact with an external power supply not represented here. It is also within the scope of the invention to provide the lamp 100 with a bayonet base.

The tungsten halogen lamp 100 is provided with a filament chamber 2 which is arranged in the outer envelope 1 with surrounding space and which encloses a tungsten filament 7 which may possibly be of the coiled-coil type. The environment between the outer envelope 1 and the filament chamber 2 is either vacuum or filled with a gas substantially without oxygen. In a preferred embodiment, the environment 3 is filled with a gas, such as nitrogen gas, which does not react with any material inside the outer envelope 1. Furthermore, the filament chamber 2 is also preferably filled with an inert gas such as argon, xenon or krypton. The tungsten filament 7 is welded at its two ends to molybdenum foils 11, 12 in two pinched end portions 13, 14, respectively, of the filament chamber 2. The pinched end portions 13, 14 and the foils 11, 12 keep the filament chamber 2 hermetically sealed. The filament chamber 2, the filament 7, the foils 11, 12 and the pinched ends 13, 14 form a light source. This light source is mounted to the base member 4 by means of two lead-in wires 15, 16, connected to the thread 17 and to the bottom contact 18 of the base member 4, respectively. The foil 11 is connected to an outer lead 8 which is in its turn, connected to a wire 5 at its other end, wire 5 being connected to the lead-in wire 15 through a lead 9. The lead 9 is stiff enough to ensure a good mechanical support for the light source such that the light source stays straight inside the lamp 100. The foil 12 is connected to an outer lead 10 which is connected at its other end to the lead-in wire 16. The assembly of the lead 8, the wire 5 and the lead 9 form a first conductive wire connected to one end 11 of the light source of the lamp 100 and to the lead-in wire 15 for the power supply. Similarly, the outer lead 10 forms a second conductive wire connected to the second, opposite end 12 of the light source and to the lead-in wire 16 for the power supply. These first and second conductive wires, connected in series with the two ends of the light source, together with the light source form a conduction path along which a supply current can circulate.

During normal operation of the lamp 100, the supply current circulates along the two conductive wires and the light source. The operating light source may reach a very high range of temperatures. Furthermore, the current develops Joule energy in each conductive wire whose effect is an increase in the temperatures of the conductive wires. In this embodiment of the invention, the wire 5 is quite distant from the light source and is mainly heated by the Joule effect. The wire is also possibly placed in close vicinity to the light source and may then also be heated by the radiation heat of the light source. The increase in the temperatures of the wires due to the radiation heat of the light source become less important in a lamp whose two conductive wires are not in close vicinity to the light source.

As is shown in FIG. 1, a piece of a conductive material 6, hereinafter referred to as safety-switch portion, is inserted in the wire 5. This safety-switch portion 6 is made of a material which reacts chemically with air, and more particularly with oxygen, causing the opening of the conduction path in a few seconds. This material may be, for example, tungsten or molybdenum, which metals burn out in oxygen in a few seconds at a temperature higher than 1100° C. and 700° C., respectively. This material may also be a compound which burns out in a few seconds in air at a temperature closer to room temperature. This material may be, for example, magnesium, aluminum, titanium, vanadium or chromium. This safety-switch portion 6 acts as an open switch for the lamp 100. Thus, in this embodiment of the invention, a portion, which is here the safety-switch portion 6, of said first conductive wire is made of a material such that the conductive path is opened when the portion is in contact with air. This first conductive wire is hereinafter referred to as a safety cut-out wire.

Figure 2:
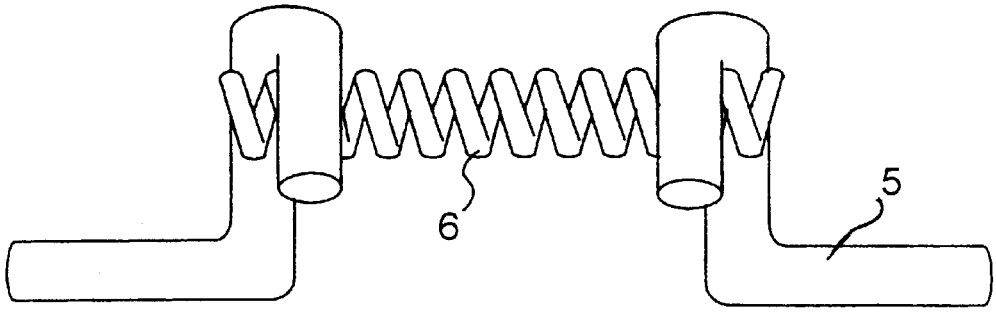
FIG. 2 is a preferred embodiment of a safety cut-out wire according to the invention.

FIG. 2 depicts a preferred embodiment of the safety-switch portion 6. It shows the wire 5 with the safety-switch 6 inserted therein. The safety-switch portion 6, which is of longitudinal shape, is pinched at its two extremities by the wire 5, as shown in FIG. 2. This way of inserting the safety-switch portion along the wire 5 is fast and easy to implement and may be chosen in the case of mass production. Any sort of connection, however, is conceivable, such as welding. The safety-switch portion 6 has a coil shape in this embodiment. Such a shape renders possible the use of a piece of material which is very thin and at the same time stiff. Thus the safety-switch portion 6 can react very quickly because of its small cross-section and is stiff enough for an easy insertion into the wire 5 and for achieving good electrical contact with the wire 5. The diameter of the safety-switch portion 6 may be a few micrometers up to a hundred micrometers. The diameter is adjusted so that the chemical reaction of the wire with oxygen takes place as fast as possible. Furthermore, the safety-switch portion has to be as short as possible in order to reduce electrical losses in the lamp. This is by no means a limitation of the invention, and a safety-switch portion of any shape, such as a bar or a piece of thin foil, may be inserted in either or both of the conductive wires.

Figure 3:
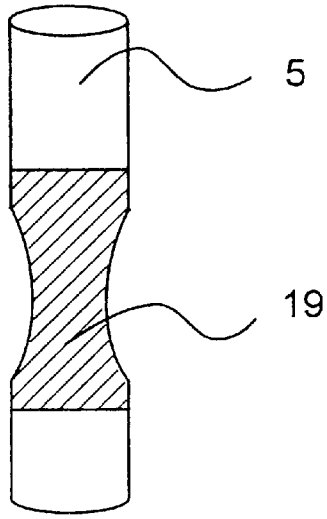
FIG. 3 is a portion of a safety cut-out wire according to the invention.

FIG. 3 depicts another embodiment of the safety-switch portion 6. In this embodiment the wire 5 is entirely or partly made of a material which will open the conduction path when in contact with air. A portion 19 of the wire 5, made of such a material, is designed with a cross-section which is reduced over a certain length. This portion 19 of the wire 5 where the cross-section is smaller acts as the safety-switch portion 6. Indeed, by reducing the cross-section, the material reacts faster in the air and the conduction path is more rapidly opened.

The embodiments described here are by no means a limitation of the invention and further embodiments of the invention could be given for any sort of lamp comprising a light source and conductive wires. The invention therefore relates to discharge lamps as well.

In the embodiments shown in the figures, furthermore, the safety-switch portion is mainly constructed as part of a conductive wire. It is possible to manufacture the two conductive wires or one of them from a material which will open the conduction path in air. In this case the entire conductive wire would act as an open switch in case of a fracture or crack of the outer envelope 1.

It must be noted that in this text, forms of the verb "comprise" do not exclude the presence of elements or steps other than those listed in a claim.

What is claimed is:

1. An electric lamp comprising:

a light source provided with a light-transmitting chamber, a conductive wire extending opposite and substantially parallel to a length of the light source and connected to an end of the light source, thus forming a conduction path with the light source, an outer sealed envelope formed from a light-transmitting material and surrounding said chamber, said conductive wire, the environment between the outer envelope and said chamber being substantially without oxygen, the conductive wire being a safety cut-out wire made entirely of a material which reacts chemically when in contact with air, causing the conduction path to open.

2. An electric lamp comprising:

a light source provided with a light-transmitting chamber, a first and a second conductive wire connected to a first and a second end of the light source, respectively, thus forming a conduction path with the light source, the first conductive wire further comprising a lead, said lead being connected to a lead-in wire, the first conductive wire and the light source being supported by said lead, and an outer sealed envelope formed from a light-transmitting material and surrounding said chamber and said first and second conductive wires, the environment between the outer envelope and said chamber being substantially without oxygen, the entire first conductive wire being made of a material which reacts chemically when in contact with air, causing the conduction path to open.

* * * * *